United States Patent [19]

Tayler

[11] 3,932,064

[45] Jan. 13, 1976

[54] ROTARY BLADED FLUID FLOW MACHINE

[75] Inventor: Colin Andrew Millar Tayler, Bristol, England

[73] Assignee: The Secretary of State for Defense in Her Britannic Majesty's Government of the United Kingdom of Great Britain and Northern Ireland, London, England

[22] Filed: Oct. 8, 1974

[21] Appl. No.: 513,159

Related U.S. Application Data

[63] Continuation-in-part of Ser. No. 335,162, Feb. 23, 1973, Pat. No. 3,869,220.

[30] Foreign Application Priority Data

| | | |
|---|---|---|
| Feb. 23, 1972 | United Kingdom | 8278/72 |
| Jan. 5, 1973 | United Kingdom | 726/73 |
| Oct. 10, 1973 | United Kingdom | 47422/73 |
| Oct. 10, 1973 | United Kingdom | 47423/73 |

[52] U.S. Cl. ..... 417/243; 417/366

[51] Int. Cl.[2] ..... F04B 23/00

[58] Field of Search ..... 415/52, 56, 179; 417/243, 417/366

[56] References Cited

UNITED STATES PATENTS

| | | | |
|---|---|---|---|
| 1,099,970 | 6/1914 | Dodd | 415/56 |
| 1,118,557 | 11/1914 | Kubiak | 415/56 |
| 1,137,590 | 4/1915 | Ehrhart | 415/56 |
| 3,031,131 | 4/1962 | Hildebrandt | 417/243 |
| 3,070,349 | 12/1962 | Stewart et al. | 415/56 |
| 3,292,899 | 12/1966 | Egli | 415/52 |
| 3,618,337 | 11/1971 | Mount | 417/366 |
| 3,736,075 | 5/1973 | Otto | 417/366 |

*Primary Examiner*—C. J. Husar
*Assistant Examiner*—G. P. LaPointe
*Attorney, Agent, or Firm*—Cameron, Kerkam, Sutton, Stowell & Stowell

[57] ABSTRACT

A multiple re-entry compressor of the kind set forth in USA Patent application Ser. No. 335,162 now U.S. Pat. No. 3,869,220 is described having inter cooling between successive passes of the rotor blading.

A further improvement is described in which variable aperture arcuate segmented flowpaths are provided.

12 Claims, 5 Drawing Figures

ROTARY BLADED FLUID FLOW MACHINE

Figure 1:
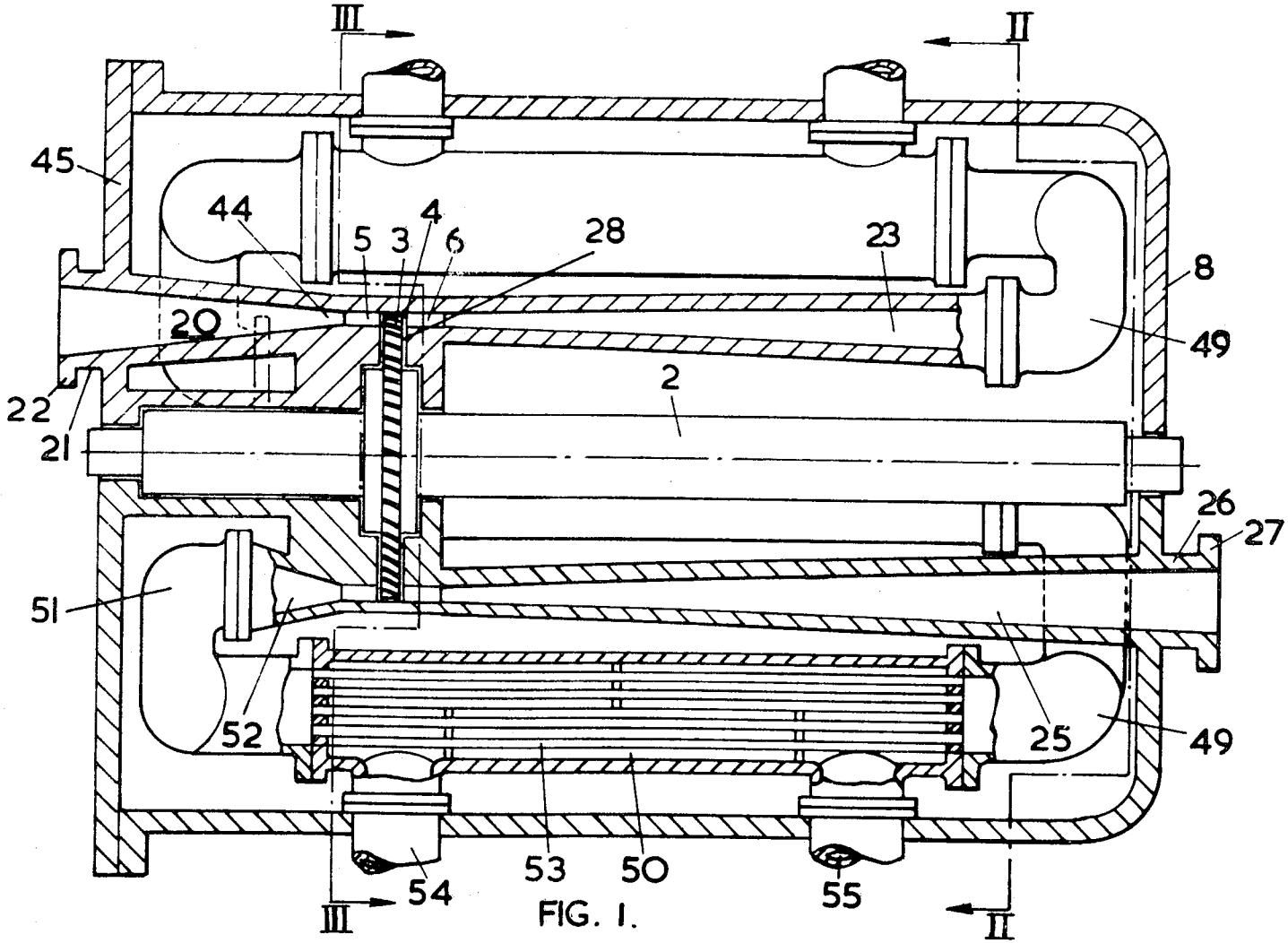

This application is a continuation in part application of U.S. Pat. application Ser. No. 335,162 now U.S. Pat. No. 3,869,220.

This invention relates to compressors, more particularly to compressors requiring a high pressure ratio and/or low mass flows for refrigeration and cryogenic pumping as described in U.S. Pat. application Ser. No. 335,162 now U.S. Pat. No. 3,869,220.

In cryogenics, pneumatics for instrumentation or control, and refrigeration in which high pressure ratios and very low flows are required, pumping of its size, weight, and the problem of oil contamination, other solutions to the pumping problem have been sought.

Thus more recently a multistage centrifugal compressor for cryogenic duties in the production of liquid helium has been developed. Because of the low flows involved, the size of each unit is very small and a very high rotational speed (up to 200,000 rpm) is required. No suitable prime mover for industrial use is widely available, and such prime movers have proved difficult to develop.

It is therefore an object of the present invention to provide a compressor for coping with low flows and/or high pressure ratios of compact size and capable of being driven by commonly available prime movers.

A further object of the invention is to provide a compressor of improved isothermal efficiency.

A subsidiary object is to provide a machine for coping with low flows and/or high pressure ratios in which oil contamination is avoided.

According to the present invention a compressor comprises a rotor; an annular aperture coaxial with said rotor and surrounding the periphery of said rotor; at least one row of rotor blades circumferentially distributed on the periphery of the rotor and projecting into said annular aperture dividing the annular aperture into an upstream side and a downstream side; a rotor blade passage wherein said row of rotor blades operates and intersecting and annular aperture; a row of downstream stator blades radially directed and circumferentially distributed around the interior of said aperture, disposed adjacent to and downstream of said rotor blades; partitions provided in the annular aperture both upstream and downstream of the rotor blades, each partition downstream of the rotor blades being substantially opposed by a corresponding partition upstream of the rotor blades; a plurality of arcuate segmented flowpaths arranged around the periphery of the rotor intersecting said row of rotor blades in a direction substantially normal to the direction of travel of the rotor blades, each of said arcuate segmented flowpaths being formed between corresponding partitions upstream and downstream of said rotor blades, the arcuate segmented flowpaths being arranged successively from a first arcuate segmented flowpath to a last arcuate segmented flowpath; a plurality of confined return flowpaths, each of said return flowpaths being associated with an arcuate segmented flowpath except the last arcuate segmented flowpath, wherein each of the confined return flowpaths runs from the downstream side of its associated segmented flowpath to the upstream side of the next following arcuate segmented flowpath; an inlet to the first arcuate segmented flowpath; an outlet from the last arcuate segmented flowpath; and at least one heat exchanger surface provided in at least one of the confined return flowpaths.

Preferably a compressor according to the present invention includes a diffuser downstream of the rotor blades.

Preferably a compressor according to the present invention includes a convergent passage on approach to each of the arcuate segmented flowpaths.

For helium compression it is preferred that heat exchanger surfaces be provided in each of the confined return flowpaths.

It is particularly convenient if a single machine may be constructed to work on a variety of fluids. This may be met by having variable aperture arcuate segmented flowpaths. In order to achieve this end it is preferred that the downstream partition be of variable position according to the fluid being worked on.

One manner in which this last end is achieved is providing slots in the downstream partitions and bolts engaging said slots, the bolts to fix the partitions in position.

Furthermore it has been found by mounting the rotor on a shaft which forms the solid rotor of an a.c. motor a very economical and simple construction of prime mover for the present compressor is achieved. It is preferred that in working upon helium, for example, oil contamination should be avoided; an elegant way of achieving this end is to provide that fluid from the high pressure side of the compressor should act as the lubricant in bearings in the machine. It is also preferred that coolant for the prime mover be provided using a closed cycle of the same fluid as is worked on in the compressor.

Figure 2:
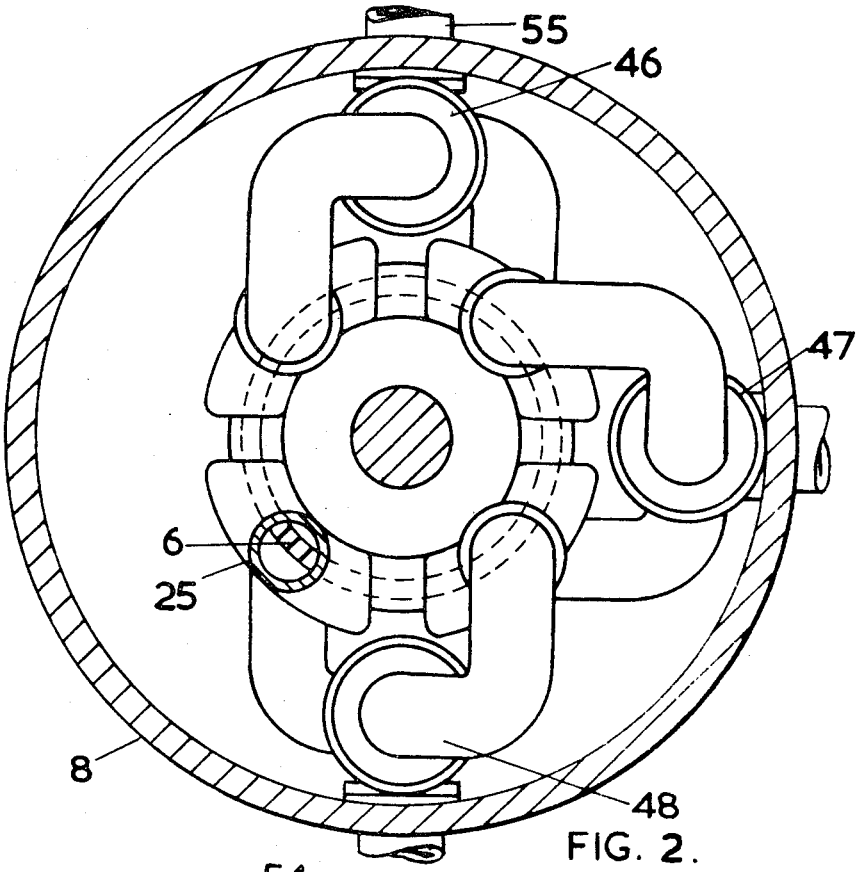
Figure 3:
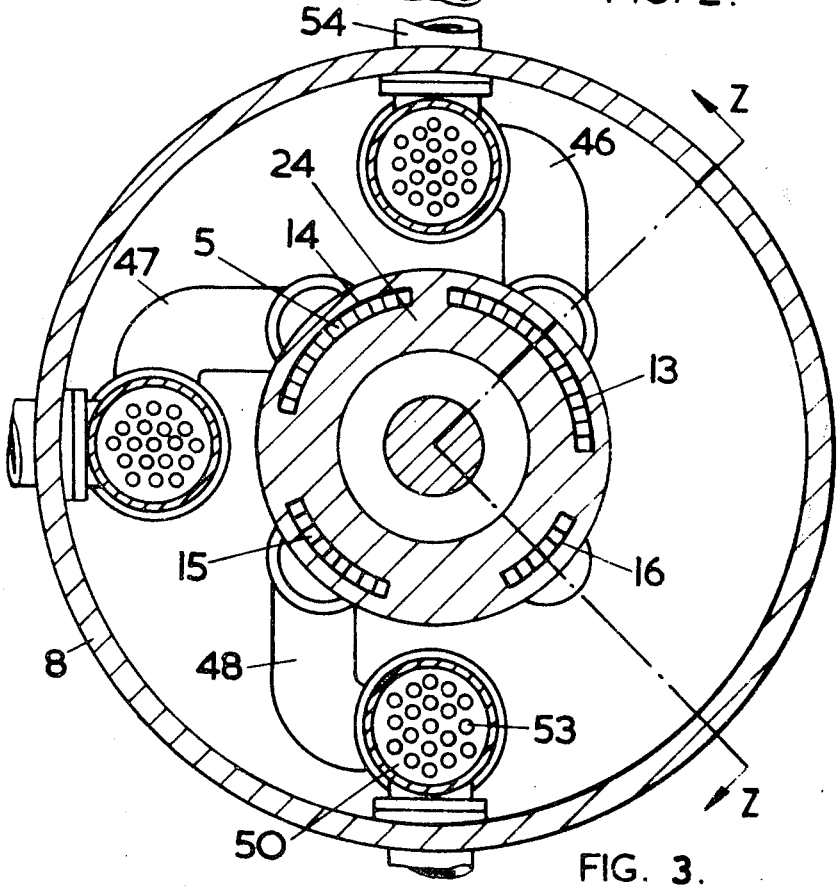

In order that the invention might be more fully understood and further features appreciated, the following description will refer to the accompanying drawings in which:

FIG. 1 is a longitudinal section of a compressor according to the invention sectioned on the line 1—1′ of FIG. 3, FIG. 2 is a transverse section of the compressor of FIG. 1 sectioned on the line 2—2′, FIG. 3 is a further transverse section of the compressor of FIG. 1 sectioned on the line 3—3′.

Figure 4:
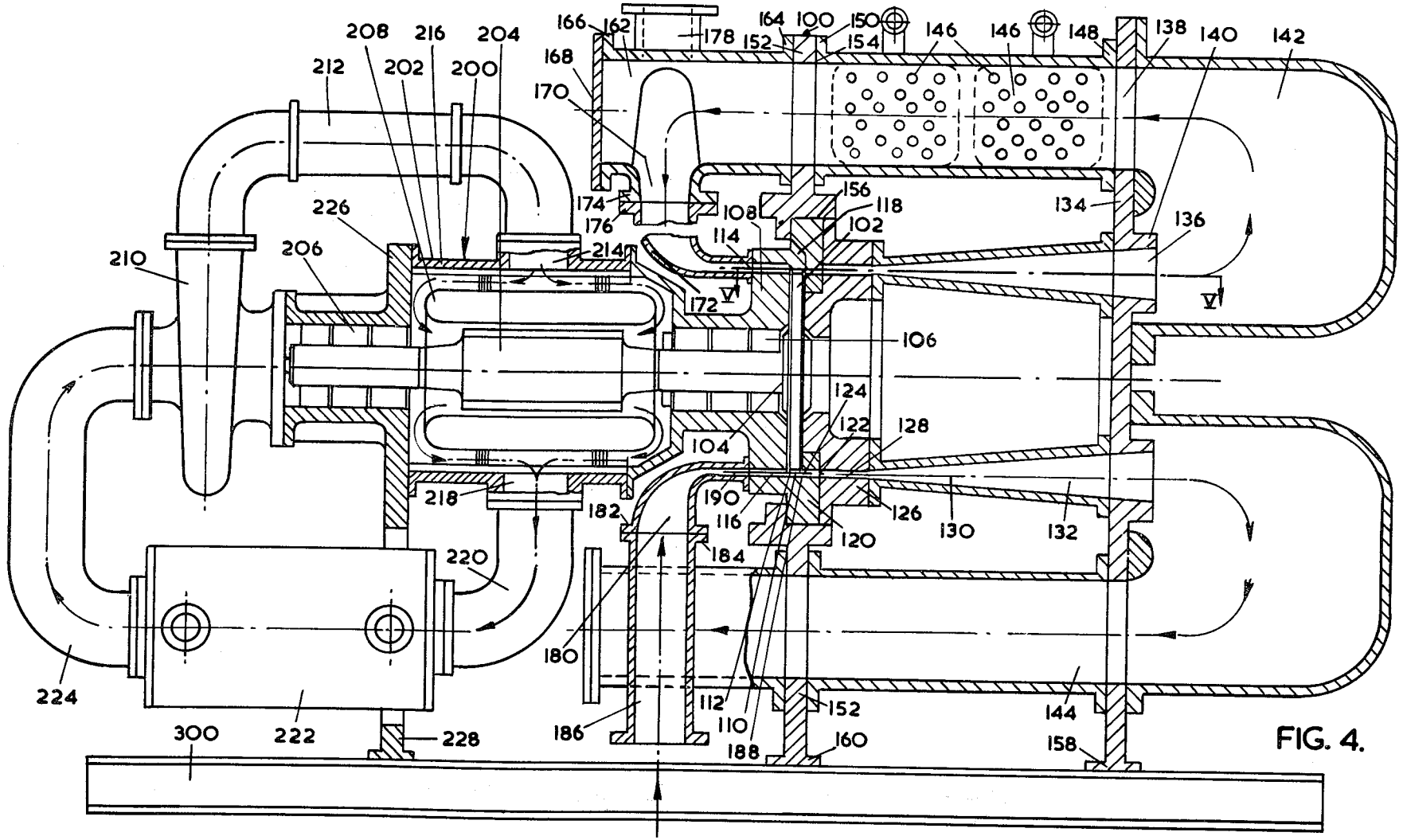
Figure 5:
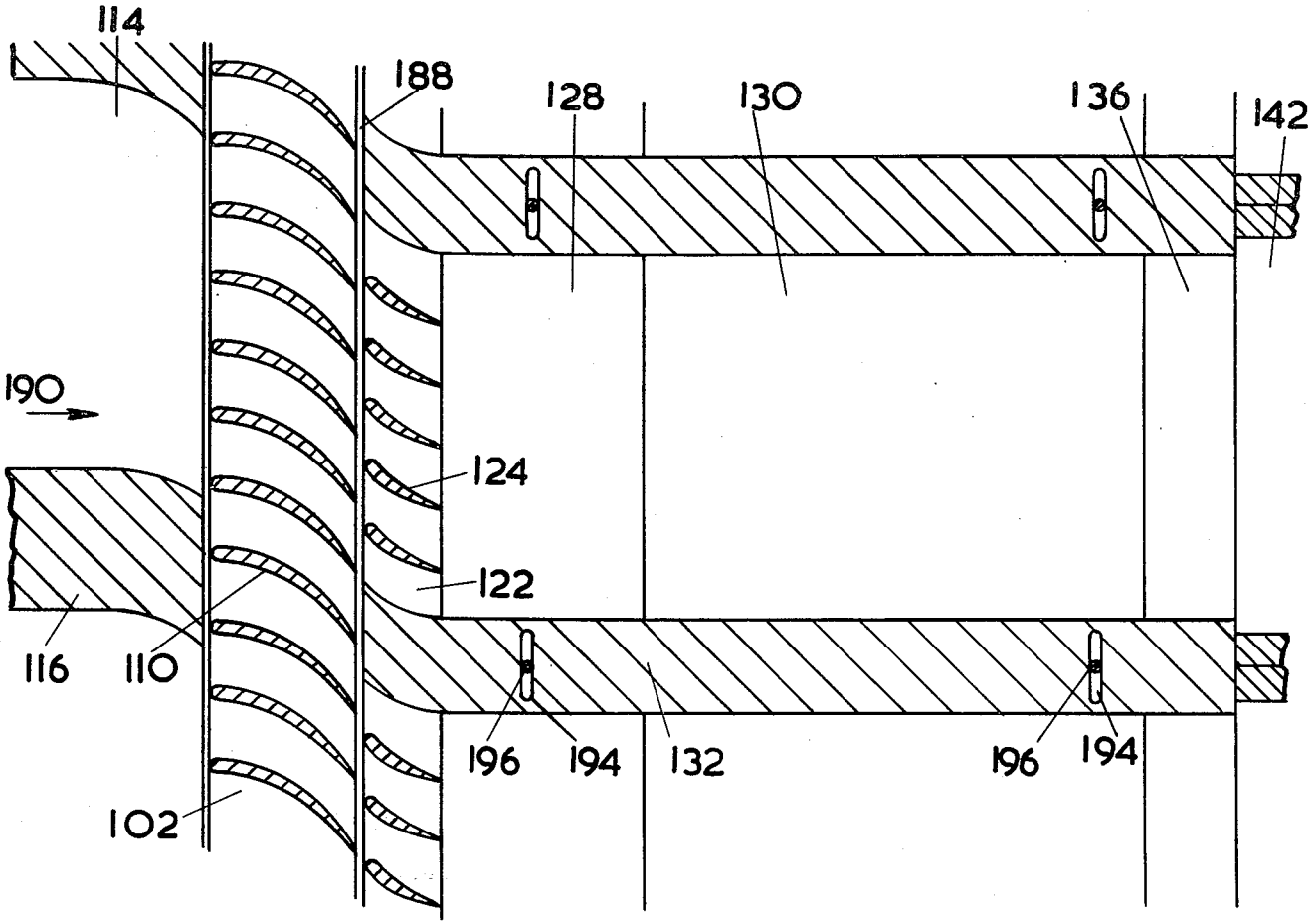

FIG. 4 is vertical section of a modified compressor in accordance with the invention showing also a prime mover particularly adapted for use in connection with this invention, and FIG. 5 is a partial section through part of a confined flowpath of FIG. 4 on the line 5—5′ of FIG. 4.

The compressor of FIGS. 1 to 3 comprises a rotor 1 mounted on a shaft 2 journalled into case 8 at one end and lateral hub 45 bolted to the case 8 at the other. A row of radially directed aerofoil sectioned rotor blades 3 are circumferentially distributed around the rotor 1 and operate in a space 4, the rotor blade passage, between a row of upstream stator blades 5 and a row of downstream stator blades 6, both of said rows of stator blades comprising a plurality of radially directed blades circumferentially disposed in an annular aperture 44 around the periphery of rotor 1. The rows of stator 5 and 6 extend inwards from the inner surface of an annulus 7 disposed outside the blade tips of the row of rotor blades 3. A toroidal space 9 outside the annulus 7 is formed between the case 8 and annulus 7 into which toroidal space the annular aperture 44 opens at both ends.

Aperture 44 is divided by radially directed partitions 24 in the row of stator blades 6 not less than one rotor blade pitch in width, and similar opposed partitions in the row of stator blades 5. These partitions provide a plurality of discreet arcuate segmented flowpaths through the row of rotor blades 3; in the compressor illustrated there are four arcuate segmented flowpaths 13–16. As this compressor is adapted to compress a compressible fluid, eg helium gas, the arcuate segmented flowpaths are of decreasing aperture from the first 13 to the last 16.

A convergent passage passes through a lateral hub 45 of the case and forms an inlet 20 to the first arcuate segmented pass 13. The wall 21 of inlet 20 is provided with a flange 22 at its outer end which may be used to connect the compressor to a low pressure source of compressible fluid. At its inner and the wall 21 is formed integrally with the partitions in the row of stator blades 5 defining the arcuate segmented flowpath 13.

Downstream of arcuate segmented flowpath 13 is provided a feedback flowpath 46 around the outside of the rotor to the next arcuate segmented flowpath 14 through a further portion of the row of rotor blades 3. Subsequent feedback flowpaths 47, 48 from downstream of arcuate segmented flowpath 14 to upstream of arcuate segmented flowpath 15, and from downstream of arcuate segmented flowpath 15 to upstream of arcuate segmented flowpath 16 provide a closed confined flowpath from the inlet 20 to an outlet 25 downstream of arcuate segmented flowpath 16. The wall 26 of outlet 25 has a flange 27 which may be connected to a high pressure sink for the compressed fluid.

Feedback flowpaths 46, 47, 48 each comprise a confined path through a divergent diffuser 23, an offset 180° bend 49, return duct 50, offset 180° bend 51, and convergent channel 52 from the downstream side of one arcuate flowpath to the upstream side of the next following arcuate flowpath. The side walls of the divergent diffusers 23 are integrally formed with the partitions 24. Divergent diffusers 23 are each connected through an offset 180° bends 49 to a return duct 50 around the outside of rotor 1. The return duct 50 is provided with intercooling comprising, in this instance, a honeycomb of piping 53 through which coolant fluid may pass between an inlet 54 and outlet 55. The flowpath on leaving return duct 50 enters another offset 180° bend 51 to a convergent passage 52 on the upstream side of the next following arcuate segmented flowpath through the row of rotor blades 3.

The provision of intercooling in the return ducts 50 greatly improves the isothermal efficiency of machines of this type.

When the machine is to be used to operate on compressible fluids, such as helium gas, the arcuate segmented flowpaths through the row of rotor blades are of decreasing aperture from the first 13 to the last 16; furthermore the cross-sectional areas of equivalent parts of the feedback flowpaths 46, 47, 48 also decrease from the first 46 to the last 48.

The rotor blades 3 are normally driven from a lower pressure arcuate segmented flowpath to a higher pressure arcuate segmented flowpath, that is in such a direction as to drive any fluid carried over in the rotor blades from a lower pressure to a higher pressure, eg from arcuate segmented flowpath 14 to arcuate segmented flowpath 15.

In this embodiment the partitions are several stator blade pitches in thickness, and leakage between successive passes is very small.

Rotor 1 and its blades 3 are formed from a single disc forging, the blades 3 being machined to an aerofoil section integrally from the forged disc. In order to prevent leakage from the blade tips and between arcuate flowpaths, the row of rotor blades 3 are manufactured to have close tolerances with the rows of stator blades 5 and 6. Furthermore to prevent leakage along the face of the rotor, seals 28 are provided between both faces of the rotor and the body of the machine.

In operation, compressible fluid from a low pressure source enters the compressor through convergent entry channel 20 to arcuate segmented flowpath 13 through a portion of the row of rotor blades 3. The inlet flow makes its first pass through a portion of the upstream row of stator blades 5 separated from flows in the adjoining arcuate segmented flowpaths 14 and 16 by the partitions. After passing through the upstream stator blades where the flow is directed towards the rotating rotor blades at the required angle, energy before being fed back to the next following arcuate segmented flowpath.

The described method of intercooling in FIGS. 1 to 3 with a honeycomb of longitudinal water cooling pipes along the return duct is intended as merely being illustrative of the intercooling. Many methods of providing intercooling will occur to those versed in the art and any such method could be used in the present invention.

It may be found advantageous in the compressor of FIGS. 1 to 3 to replace the 180° offset right angle bends by plenum chambers.

Moving onto FIG. 4 an alternative compressor 100 according to the invention is drivable from a prime mover 200, the whole assembly being mounted on a bed plate 300.

The compressor 100 comprises a rotor 102 mounted on a shaft 104. The shaft 104 is journalled in a gas bearing 106 itself retained in a housing 108. A plurality of radially directed rotor blades 110 are circumferentially distributed around the rotor 102 and operate in a recess 112 of the housing 108. Near the periphery of the housing 108 an annular aperture 114 is provided coaxial with the shaft 104 and aligned with the ring of rotor blades 110. The aperture 114 is provided with upstream partitions 116 arranged in a manner as hereinafter described. The housing 108 has a flange 118 to which an outlet stator ring 120 is attached. The outlet stator ring 120 has an annular aperture 122 in which is provided a plurality of radially directed downstream stator blades 124 distributed around the interior of the annular aperture 122. Bolted to the outlet stator ring 120 is an outlet block 126 having a parallel walled annular passage 125 coaxial with the annular aperture 122 and of the same diameter. Again bolted to the outlet block 126 is an annular diffuser 130. Arranged in the annular apertures 122, 128 and diffuser 130 are a plurality of downstream partitions 132 (an equal number to the upstream partitions 116) and arranged to be moveable relative to the outlet stator ring 120 as described below in relation to FIG. 5. The effect of the downstream partitions 132 is to divide the annular apertures 122, 128 and diffuser 130 into a plurality of separate passages. The diffuser 130 is supported in an end plate 134 having a number of first apertures 136 corresponding the passages through the diffuser 130 and second associated apertures 138 arranged outside the first apertures. The peripheries of the first apertures are provided with divergent walls 140 to form diffuser extensions. Providing a closed flowpath between each of the first apertures 136 and their associated second apertures 138 are a plurality of plenum chambers 142. Associated with each plenum chamber are return pipes 144 whose longitudinal axis are substantially parallel to the rotor axis of the machine, some at least of the return pipes 144 are provided with intercoolers 146 to provide heat exchange surfaces for fluid passing. The pipes 144 are provided with flanges 148 and 150 at each end the flanges 148 bolted to the end plate 134 and the flanges 150 bolted to bearing housing support plate 152.

The bearing housing support plate 152 has apertures 154 corresponding to the return pipes 144 and a large central aperture 156 in which the bearing housing 108, outlet stator ring 120, and outlet block 126 are mounted. Both the end-plate 134 and the housing support plate 152 are provided with feet 158 and 160 respectively engaging the bedplate 300 to support the machine.

Returning to the detailed aspects of the machine itself. The passages between the upstream partitions 116 and the downstream partitions 132 intersect the rotor blades 110 in a plurality of arcuate segmented flowpaths successively arranged around the periphery of the rotor between a first arcuate segmented flowpath and a last arcuate segmented flowpath. Between each arcuate segmented flowpath through the rotor blades is provided a confined return flowpath. These confined flowpaths are each formed between partitions in the diffuser 130 continuing into a plenum chamber 142 and back around the outside of the rotor through a return pipe 144 and into an inlet end chamber 162. Each inlet end chamber 162 is provided with flanges 164 and 166 at opposite ends. Flange 164 is bolted to bearing housing support plate 152 such that a continuous flowpath is provided from an associated return pipe 144 through an aperture 154 and into each inlet end chamber 162. The other flange 166 has bolted thereto an end closure cap 168. From each of the inlet end chambers 162 off-set 90° outlets 170 are connected to convergent inlet elbows 172 by bolting together a flange 174 on the outlet 170 to a flange 176 on the inlet elbow 172. Thus access to the next arcuate segmented flowpath in the series is provided and the return flowpath completed. For example should there by five arcuate segmented flowpaths through the rotor blades, four return flowpaths each made up as described will be provided. The outlet from the last arcuate segmented flowpath is constructed in a similar manner to the return flowpaths save that an outlet elbow 178 is provided bolted to the bearing housing support plate instead of an inlet end chamber. Access to the first arcuate segmented flowpath is provided through a first convergent inlet elbow 180. This first convergent inlet elbow 180 has a flange 182 to which is bolted a flange 184 of an inlet manifold 186.

It will be seen from the FIG. 4 that the effect of the construction of bearing housing 108, outlet stator ring 120, and outlet bloack 126, is to provide a rotor blade passage 188 which intersects normally a annular passage 190 formed by annular apertures 114, 122 and diffuser 130; the annular passage 190 being effectively surrounded by an annulus 192. The annular passage is effectively divided by the radially directed partitions 116 in the upstream side of the rotor blades 110 and 132 in the downstream side of the rotor blades 110.

The machine is driven from a prime mover 200. The shaft 104 of the machine is extended to form a solid rotor 204 of an a.c. motor 202. The rotor 204 is journalled in bearing 106 in the machine on the one hand and into gas bearing 206 on the other hand. The gas bearings are served with high pressure fluid from the outlet side of the machine. The windings and the stator 208 and other parts of the a.c. motor are cooled using a closed circuit of the fluid being compressed, for example, helium. The closed circuit comprises a centrifugal pump 210 driven from the rotor 204 driving fluid around ducting 212 to issue from an aperture 214 in the case 216 of the a.c. motor 202 over the stator windings 208. A second aperture 218 is provided in the case 216 into which the warmed fluid collects and further ducting 220 links this aperture to a heat exchanger 222. From heat exchanger 222 a U-bend 224 leads fluid back to the low pressure side of the pump 210. An end cover 226 of the motor 202 is extended to a foot 228 which engages the bed-plate 300 and supports the prime mover.

The machine was particularly designed to operate upon helium as the working fluid. Nevertheless it is equally applicable to use with other gases. Furthermore it is possible to adapt the machine to operate upon different gases. To achieve this latter end the machine may be constructed with variable aperture arcuate segmented flowpaths, such an arrangement is illustrated in FIG. 5 which is a partially developed section on the line 5—5' of FIG. 4.

In FIG. 5 aperture 114 is illustrated divided by a plurality of partitions 116 on the upstream side of the rotor blades 110 and aperture 122 divided by partitions 132 in the downstream side of rotor blades. As can be seen the apertures 114 and 122 in conjunction with aperture 128 and the diffuser 130 form an annular passage 190 intersecting the rotor blade passage 188 normally. The downstream partitions 132 are offset slightly, in the direction of travel of the rotor 102, from the corresponding partitions 116. Also illustrated in FIG. 5 are the downstream stator blades located in the outlet stator ring 120. To adapt the machine for different fluids, the downstream partitions 132 are constructed to have a certain freedom of movement circumferentially in the annular passage 190. This is achieved by the provision of a pair of slots 194 transversely of the partitions 132 and bolts 196 passing through the slots 194 engaging the outer and inner walls of the diffuser 130 and outlet block 126. It has been found that the amount of movement of the partitions required to adapt the machine from say helium to oxygen is quite small and well within the range provided for by the slots 194.

It has been found convenient to construct the rotor blades 110 with ridges at their tips to have rubbing contact with the annulus 192. Thus in a running-in period these ridges can be worn away and provide a close tolerance fit for the rotor blades in the rotor blade passage.

I claim:

1. A compressor comprising:

a. a rotor;

b. an annular aperture coaxial with said rotor and surrounding the periphery of said rotor;

c. at least one row of rotor blades circumferentially distributed on the periphery of the rotor and projecting into said annular aperture dividing the annular aperture into an upstream side and a downstream side, d. a rotor blade passage wherein said row of rotor blades operates and intersecting said annular aperture;

e. a row of downstream stator blades radially directed and circumferentially distributed around the interior of said aperture, disposed adjacent to and downstream of said rotor blades;

f. partitions provided in the annular aperture both upstream and downstream of the rotor blades, each partition downstream of the rotor blades being substantially opposed by a corresponding partition upstream of the rotor blades;

g. a plurality of arcuate segmented flowpaths arranged around the periphery of the rotor intersecting said row of rotor blades in a direction substantially normal to the direction of travel of the rotor blades, each of said arcuate segmented flowpaths being formed between corresponding partitions upstream and downstream of said rotor blades the arcuate segmented flowpaths being arranged successively from a first arcuate segmented flowpath to a last arcuate segmented flowpath;

h. a plurality of confined return flowpaths, each of said return flowpaths being associated with an arcuate segmented flowpath except the last arcuate segmented flowpath, wherein each of the return flowpaths runs from the downstream side of its associated segmented flowpath to the upstream side of the next following arcuate segmented flowpath;

i. an inlet to the first arcuate segmented flowpath;

j. an outlet from the last segmented flowpath;

k. at least one heat exchanger surface provided in at least one of the confined return flowpaths.

2. A compressor according to claim 1 including a diffuser downstream of the rotor blades.

3. A compressor according to claim 2 including a convergent passage on approach to each of the arcuate segmented flowpaths.

4. A compressor according to claim 3 including heat exchanger surfaces in each of the confined return flowpaths.

5. A compressor according to claim 1 including variable aperture arcuate segmented flowpaths.

6. A compressor according to claim 5 including downstream partitions being variable position according to the fluid to be worked on.

7. A compressor according to claim 6 including slots in said downstream partitions and both engaging said slots, the bolts to fix the partitions in position.

8. A compressor according to claim 1 wherein the rotor is mounted on a shaft which shaft is a solid rotor of an a.c. motor.

9. A compressor according to claim 8 including bearings wherein said shaft is journalled said bearings being fluid bearings and adapted to receive fluid from the high pressure side of said compressor.

10. A compressor according to claim 8 including a fluid circuit to windings of said motor, said fluid circuit including the working fluid of the machine as the coolant.

11. A compressor according to claim 10 wherein said fluid circuit includes a pump to drive fluid around said circuit and a heat exchanger to cool fluid and wherein said pump is drivable from said shaft.

12. A compressor comprising:

a. a rotor;

b. an annular aperture coaxial with said rotor and surrounding the periphery of said rotor;

c. at least one row of rotor blades circumferentially distributed on the periphery of the rotor and projecting into said annular aperture dividing the annular aperture into an upstream side and a downstream side;

d. a rotor blade passage wherein said row of rotor blades operates and intersecting said annular aperture;

e. a row of downstream stator blades radially directed and circumferentially distributed around the interior of said aperture; disposed adjacent to and downstream of said rotor blades;

f. partitions provided in the annular aperture both upstream and downstream of the rotor blades each partition downstream of the rotor blades being substantially opposed by a corresponding partition upstream of the rotor blades;

g. a plurality of arcuate segmented flowpaths arranged round the periphery of the rotor intersecting said row of rotor blades in a direction substantially normal to the direction of travel of the rotor blades, each of said arcuate segmented flowpaths being formed between corresponding partitions upstream and downstream of said rotor blades, the arcuate segmented flowpaths being arranged successively from a first arcuate segmented flowpath to a last arcuate segmented flowpath;

h. a plurality of confined return flowpaths, each of said return flowpaths being associated with an arcuate segmented flowpath, wherein each of the return flowpaths run from the downstream side of its associated segmented flowpath to the upstream side of the next following arcuate segmented flowpath;

i. an inlet to the first arcuate segmented flowpath j. an outlet from the last arcuate segmented flowpath;

k. at least one heat exchanger surface provided in at least one of the confined return flowpaths;

l. a diffuser downstream of the rotor blades;

m. a convergent passage on approach to each of the arcuate segmented flowpaths;

n. the downstream partitions being variable position according to the fluid being worked on; and o. the rotor being mounted on a shaft which is the solid rotor of an a.c. motor.

* * * * *

UNITED STATES PATENT AND TRADEMARK OFFICE

CERTIFICATE OF CORRECTION

PATENT NO. : 3,932,064

DATED : Jan. 13, 1976

INVENTOR(S) : Colin Andrew Millar Tayler

It is certified that error appears in the above-identified patent and that said Letters Patent are hereby corrected as shown below:

Cover sheet, item [73], "Defense" should read --Defence--. Column 1, line 14, after "pumping" insert --is usually carried out by a reciprocating compressor; however, because--. Column 4, line 22, after "energy" insert --is imparted to the fluid. Some of the energy is converted to pressure rise in the diffusing rotor blade passages, and some in the following stationary row of downstream stator blades 6. Further conversion of fluid velocity to pressure rise is carried out in the following diffuser 23 forming part of feedback flowpath 46. The fluid then turns through 180° in bend 49.

The fluid passes back through duct 50 making contact with the cooling surface on intercooling piping 53 before executing another 180° turn in bend 51 from which convergent channel 52 takes the fluid into the stator blades in arcuate segmented flowpath 14. The fluid on leaving arcuate segmented flowpath 14 repeats the process in feedback flowpath 47. The fluid flowpath is therefore of a controlled pattern, the width of each successive arcuate flowpath being designed to match the reduced area required for the increase in fluid density. The fluid passes through each of the arcuate segmented flowpaths 13, 14, 15, 16 in turn being directed from the downstream side of one arcuate segmented flowpath to the upstream side of the next feedback flowpaths 46, 47, 48 in turn. The fluid leaves the last arcuate segmented flowpath 16 and enters the diffusing outlet 25 by which it leaves the compressor at a high pressure, having passed through portions of the row of rotor blades four times.

The invention has been particularly described in its simplest form with the rotor having blades a single row of rotor blades and one row each of upstream and downstream stator blades. The invention is not limited to this configuration, for the rotor may have a plurality of rows of rotor blades operating between a plurality of rows of stator blades, so that when fluid passes through a arcuate flowpath it undergoes multistage compression--.

UNITED STATES PATENT AND TRADEMARK OFFICE

CERTIFICATE OF CORRECTION

PATENT NO. : 3,932,064

DATED : Jan. 13, 1976

INVENTOR(S) : Colin Andrew Millar Tayler

It is certified that error appears in the above-identified patent and that said Letters Patent are hereby corrected as shown below:

Column 7, line 3, change the comma to a semi-colon.
Column 8, line 49, after "flowpath" insert a semi-colon.

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*